US009194148B1

(12) United States Patent
Koller et al.

(10) Patent No.: US 9,194,148 B1
(45) Date of Patent: Nov. 24, 2015

(54) WATER BONDING DEVICE AND METHODS OF USE

(71) Applicants: Barrett Koller, Pueblo, CO (US); Andrew Heggie, Canon City, CO (US)

(72) Inventors: Barrett Koller, Pueblo, CO (US); Andrew Heggie, Canon City, CO (US)

( * ) Notice: Subject to any disclaimer, the term of this patent is extended or adjusted under 35 U.S.C. 154(b) by 467 days.

(21) Appl. No.: 13/676,004

(22) Filed: Nov. 13, 2012

(51) Int. Cl.
*E04H 4/00* (2006.01)
*E04H 4/06* (2006.01)

(52) U.S. Cl.
CPC ..... *E04H 4/06* (2013.01)

(58) Field of Classification Search
CPC ..... E04H 4/1236
USPC ..... 4/498–513; 482/55
See application file for complete search history.

(56) References Cited

U.S. PATENT DOCUMENTS 3,748,810 A * 7/1973 Mattingly ..... 52/741.12
4,969,874 A * 11/1990 Michel et al. ..... 604/140
5,382,752 A * 1/1995 Reyhan et al. ..... 174/50
5,752,860 A * 5/1998 Greaves ..... 439/781
6,684,588 B1 * 2/2004 Jones ..... 52/298
6,733,345 B2 5/2004 Weise
7,269,861 B1 * 9/2007 Miller ..... 4/609
7,655,116 B1 * 2/2010 Tilsner ..... 204/196.15
7,732,707 B2 * 6/2010 Kim ..... 174/7
8,152,538 B1 * 4/2012 Papageorge ..... 439/100
2004/0009713 A1 * 1/2004 Weise et al. ..... 439/721
2005/0091736 A1 * 5/2005 Smith ..... 4/502
2008/0216877 A1 * 9/2008 Lawson ..... 134/111
2011/0265420 A1 11/2011 Saviano
2012/0314333 A1 * 12/2012 Takeda et al. ..... 361/230

* cited by examiner

*Primary Examiner* — Lori Baker
(74) *Attorney, Agent, or Firm* — Leyendecker & Lemire, LLC

(57) ABSTRACT

A water bonding device for electrically grounding a swimming pool is described. Embodiments include a bonding electrode installed in a pool skimmer or pump strainer. The bonding electrode typically resides in a skimmer or strainer cavity, and a ground conductor coupled directly to the electrode extends out of the skimmer or strainer through a port. A plug assembly forms a water tight seal against the port and the ground conductor, providing a water tight access point for the ground conductor to enter the pool skimmer or pump strainer. The ground conductor is typically electrically connected to both the bonding electrode and a ground pole residing at ground potential.

20 Claims, 8 Drawing Sheets

WATER BONDING DEVICE AND METHODS OF USE

BACKGROUND

The 2008 National Electrical Code (NEC) requires that swimming pool water be electrically bonded in order to place the water at the same electrical potential as ground. Conductivity between the water and ground must be maintained by a solid copper conductor not smaller than #8 AWG. Bonding is also required for various other pool components in order to reduce voltage gradients between and among the pool water and the various components.

At least 9 square inches of bonding electrode surface area must be in contact with the water according to the NEC. However, stray voltage in the ground can create a slight voltage gradient wherein the ground is at higher potential than the pool water. Under such circumstances, the bonding electrode can slowly dissolve into the water through electrolysis, and insufficient bonding electrode surface area can result.

Finding or creating a port of entry for the grounding conductor presents a challenge for pool bonding, as does placing the bonding electrode at a location where it remains in contact with the pool water under varying conditions, such as where the water level drops, during pump failure or malfunction, or where water in pool filtration and recirculation plumbing becomes displaced by air.

Accordingly, an advantageously located replaceable binding electrode that utilizes an existing port of entry for the ground conductor is needed.

DETAILED DESCRIPTION

Figure 1:
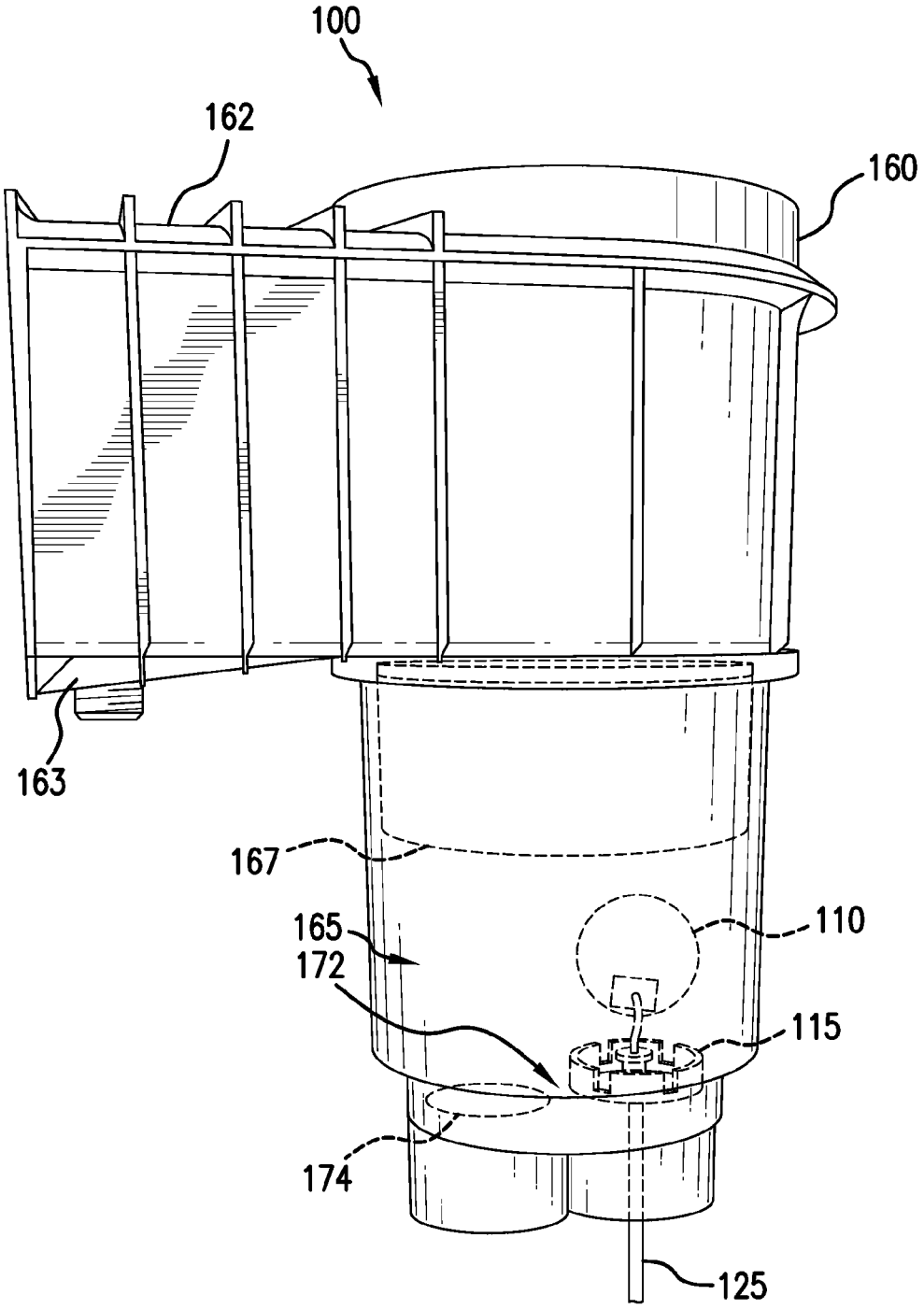
FIG. 1 is a side, perspective view of a water bonding device according to an embodiment of the present invention.
Figure 2:
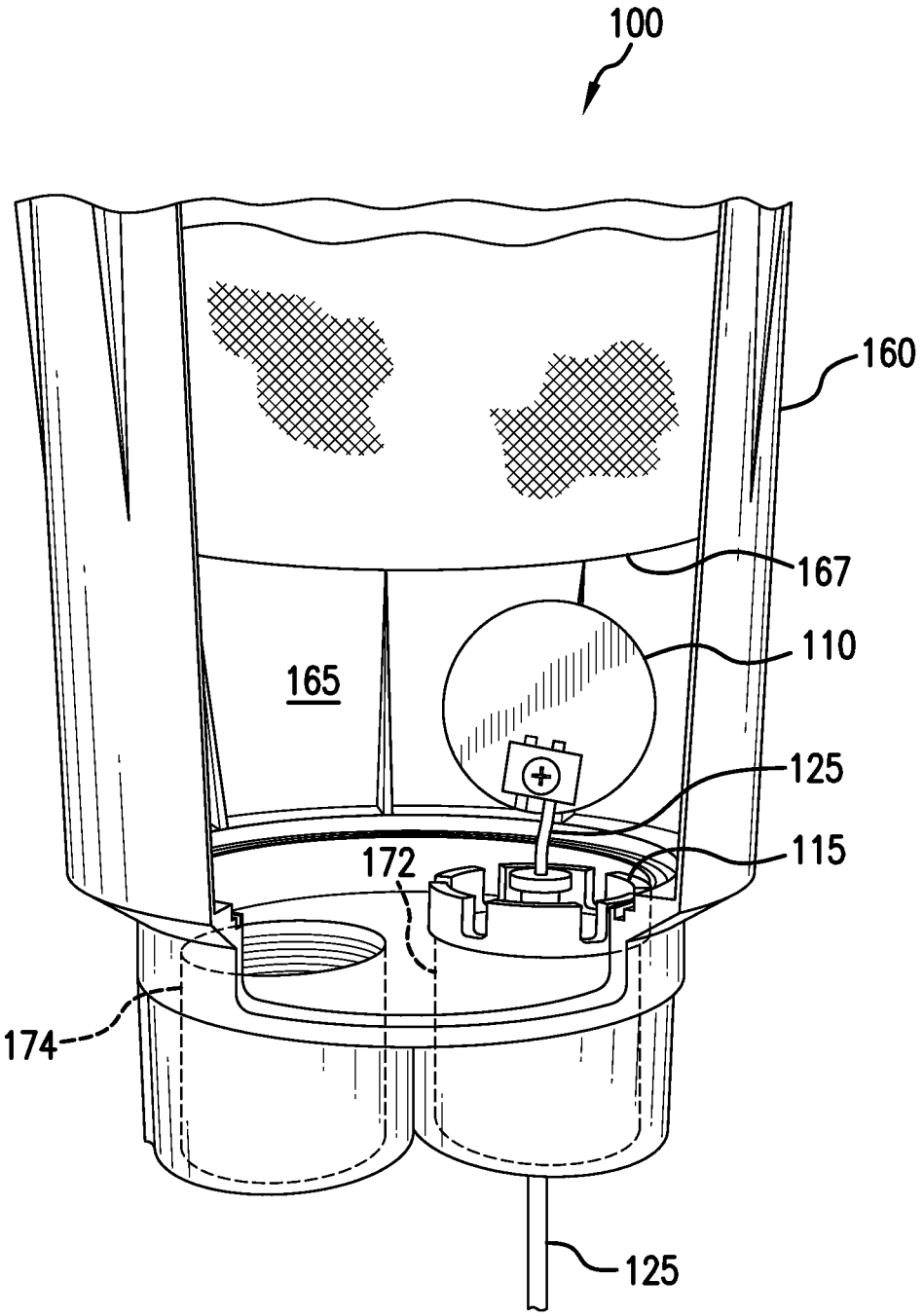
FIG. 2 is a side, perspective, cut-away view of a water bonding device according to an embodiment of the present invention.

Embodiments of a water bonding device according to the present invention include a bonding electrode installed in filter inlet component. The filter inlet component is typically a pool skimmer or pump strainer. The pool skimmer version is typically used with built-in swimming pools, and the pump strainer version with above-ground pools.

The water bonding device typically includes a bonding electrode residing in a skimmer or strainer cavity and a ground conductor coupled directly to the electrode and extending out of the skimmer or strainer through a port. A plug assembly forms a water tight seal against the port and the ground conductor, providing a water tight access point for the ground conductor to enter the filter inlet component. The ground conductor is typically electrically coupled to both the bonding electrode and a ground pole residing at ground potential.

The bonding electrode typically has a surface area greater than 9.0 square inches, which is the minimum surface area required for bonding a swimming pool. In typical use, the filter inlet component includes a cavity filled with water, within which the bonding electrode is submerged in water. The water in the cavity is typically in liquid communication with the water in the swimming pool. Accordingly, the bonding electrode is configured to bond pool water and all components electrically connected thereto. The water bonding electrode is easily installed, uninstalled, and replaced, in case the electrode dissolves, degrades, or otherwise becomes unsuitable for its desired purpose.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "pool," as used in this specification and appended claims, refers to swimming pools, hot tubs, spas, and similar structures where persons are intentionally in contact with reservoirs of water or wet surfaces surrounding the reservoirs. The contact can include being fully or partially submerged in the water.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," and "below," as used in this specification and appended claims, refer to relative positions of identified elements, components, or objects, where the components or objects are oriented in an upright position as normally installed or used.

A First Embodiment Water Bonding Device

Figure 3:
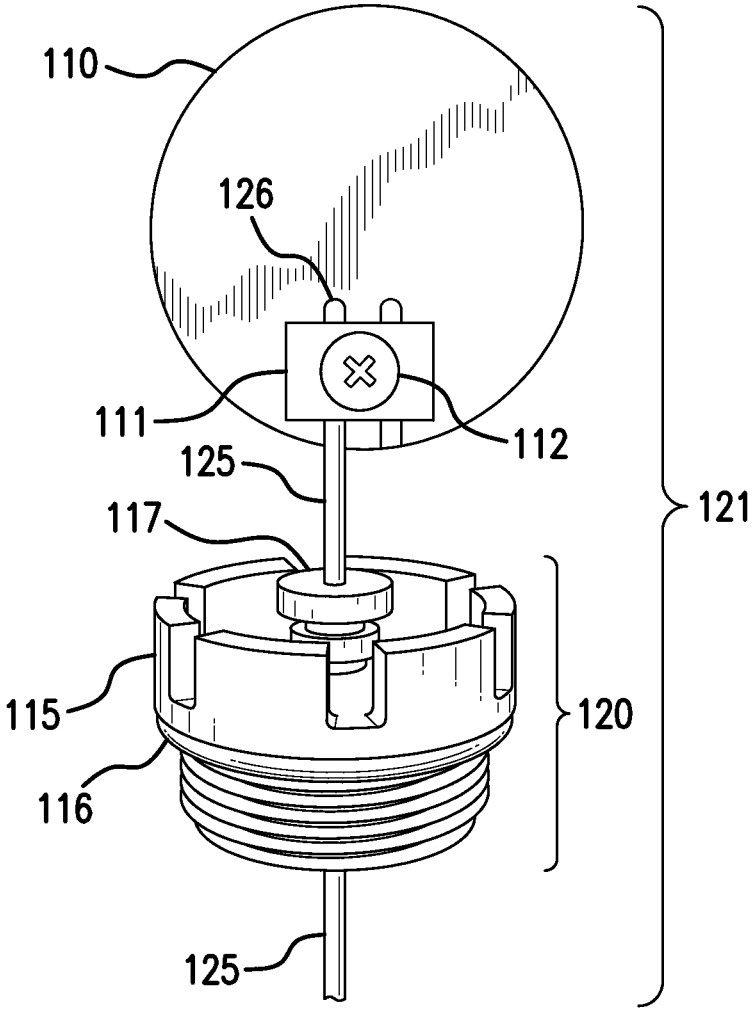
FIG. 3 is a perspective view of an electrode assembly according to an embodiment of the present invention.
Figure 4:
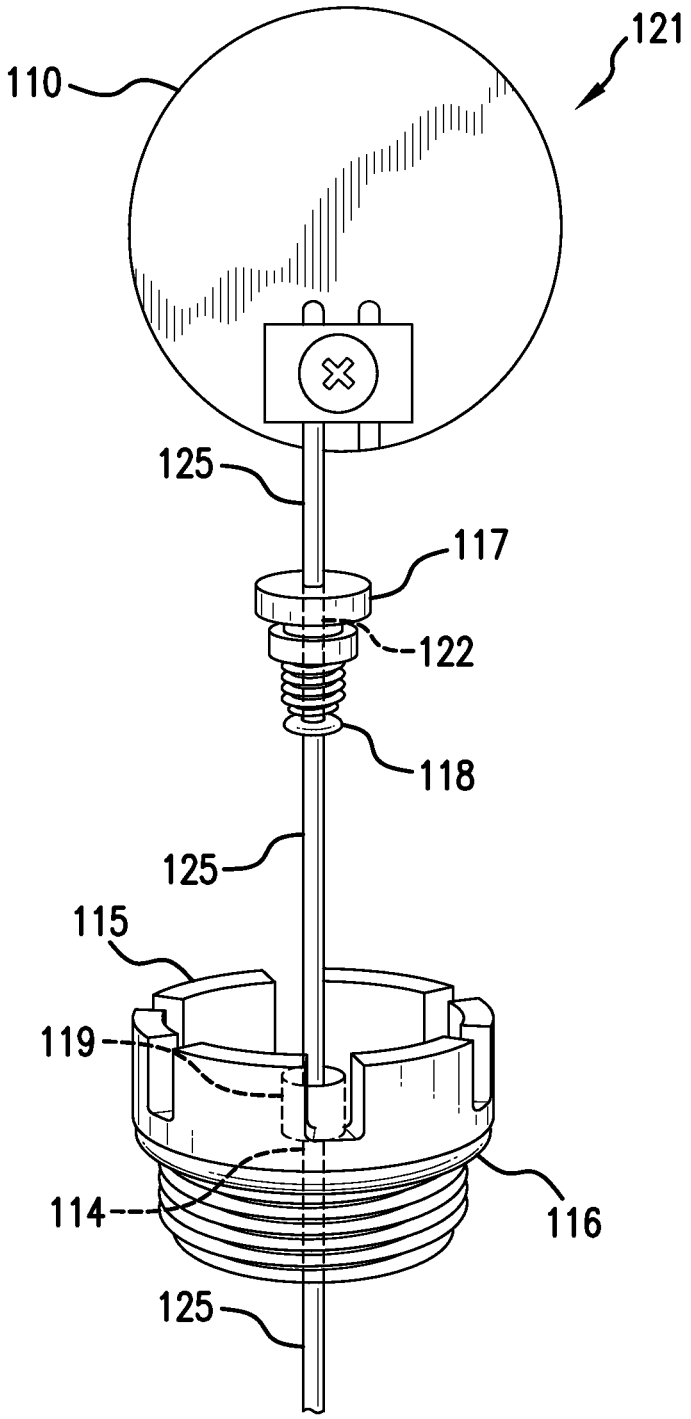
FIG. 4 is a perspective view of an electrode assembly according to an embodiment of the present invention.
Figure 5:
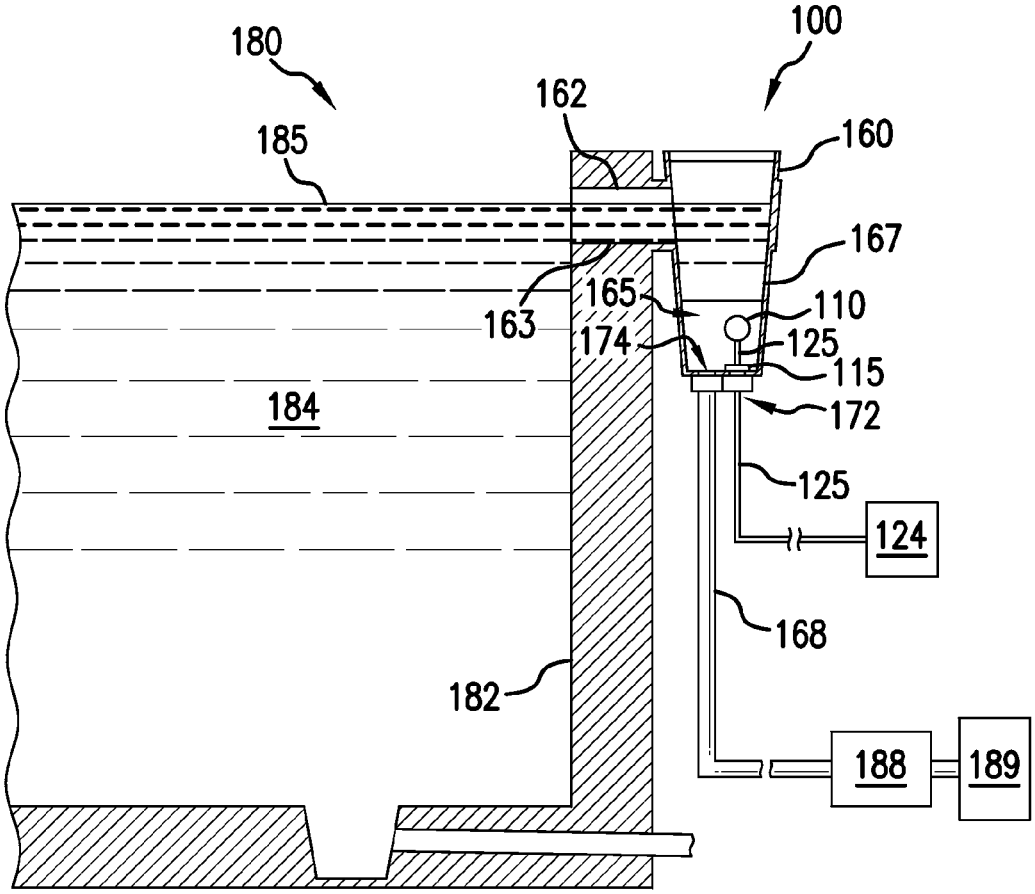
FIG. 5 is a side cross-section view of a water bonding device installed in a swimming pool, according to an embodiment of the present invention.

A first embodiment water bonding device 100 is illustrated in FIGS. 1-5. The first embodiment water bonding device comprises a filter inlet component 160 including a main cavity 165, and a bonding electrode 110 residing within the main cavity 165. The filter inlet component 160 of the first embodiment is a pool skimmer familiar to persons skilled in the art. The pool skimmer is shown in FIG. 5 installed in a swimming pool 180 built into the ground. The pool skimmer includes a skimmer basket 167 for filtering water that flows through the main cavity 165. The filter inlet component 160 further comprises a first port 172 and a second port 174.

The first embodiment water bonding device 100 further comprises a plug 115 threaded into the first port 172, and thus removably installed therein. The water bonding device 100 further includes a ground conductor 125 directly and removably coupled to the bonding electrode 110 by use of a clamp 111 that pinches the ground conductor 125 proximate its first end 126 between the clamp 111 and the bonding electrode 110. The bonding electrode 110 is electrically connected to the ground conductor 125 in addition to being removably coupled thereto. A clamp screw 112 threads into the bonding electrode 110 and thus presses the clamp 111 against the ground conductor 125 and the bonding electrode 110, holding the ground conductor 125 fast therebetween.

The ground conductor 125 is typically, but not necessarily, a #8 AWG solid copper wire. Variations include a ground conductor comprising other electrically conducting material. In some embodiments, the ground conductor 125 is bent where it enters the skimmer cavity 165, such that the bonding electrode 110 lies relatively flat against a bottom of the cavity 165. This configuration enables the electrode to fit beneath the skimmer basket 167 even where space beneath the skimmer basket is minimal.

The bonding electrode 110 is readily removable from the ground conductor 125 by loosening the clamp screw 112, which allows the ground conductor first end 126 to slide from between the clamp 111 and electrode 110. The same bonding electrode 110 or a replacement bonding electrode can be subsequently affixed to the ground conductor 125 in the same manner as described above, with a portion of the ground conductor 125 proximate the first end 126 being held fast between the clamp 111 and the electrode 110. The removable and replaceable character of the bonding electrode 110 is beneficial in circumstances where a ground potential causes the bonding electrode to dissolve or otherwise disintegrate over time, and therefore have insufficient surface area (<9.0 square inches) for adequate water bonding. The removable bonding electrode 110 can also simplify installation because it allows the ground conductor first end 126 to be inserted through the plug bore 114 and fitting bore 122

The bonding electrode 110 typically comprises a circular disk having a diameter of approximately 2.5 inches, and thus having a surface area of approximately 4.9 square inches for each of the front and back sides of the electrode 110. The bonding electrode 110 is typically approximately 0.125 inch thick, resulting in a circumferential edge having a surface area of approximately 0.98 square inch.

As best seen in FIGS. 3 and 4, the first embodiment water bonding device further comprises a conductor fitting 117 and a fitting gasket 118, both of which are configured to encircle the ground conductor 125. The conductor fitting 117 is typically a nylon thumb screw including a central bore 122. The thumb screw typically removably installs in a fitting receptacle 119. The conductor fitting 117 is typically, but not necessarily, threaded, and thus can engage in the fitting receptacle 119 via complementary threads typically residing in the fitting receptacle, resulting in a threaded coupling between the fitting receptacle and the conductor fitting. In some embodiments, the conductor fitting engages the fitting receptacle by a friction fit, twist-lock mechanism, or by other means. A plug bore 114 extends through the center of the plug 115 from a bottom of the fitting receptacle 119.

The conductor fitting 117 includes a fitting bore 122 through a center of the conductor fitting 117, and through which the ground conductor 125 extends through the conductor fitting. The fitting gasket 118 typically resides in the fitting receptacle 119 at a bottom of the conductor fitting 117. When the conductor fitting 117 is installed in the fitting receptacle 119, the fitting gasket 118 resides within the receptacle 117 and can form a water tight seal around the ground conductor 125. The fitting gasket 118 can also seat against a bottom of the fitting receptacle 119 to form a water tight seal between the conductor fitting 117 and fitting receptacle 119. Where the fitting gasket 118 is compressed between the conductor fitting and fitting receptacle, for instance where the conductor fitting threads tightly into the fitting receptacle, a watertight seal is more readily formed by the gasket 118.

The fitting gasket 118 of the first embodiment water bonding device 100 typically, but not necessarily, comprises an elastomeric O-ring familiar to persons skilled in art. Embodiments of fitting gaskets include, but are not limited to, compression fittings, ferrules, seals, gaskets, and the like.

The first embodiment water bonding device 100 further comprises a plug gasket 116 adapted to form a water tight seal between the plug 115 and the filter inlet component 160 when the plug threads into or is otherwise installed in the first port 172. The plug gasket seals against the plug 115 and filter inlet component 160 when compressed therebetween. The plug gasket 116 of the first embodiment water bonding device 100 typically, but not necessarily, comprises an elastomeric O-ring familiar to persons skilled in art. Variations of plug gaskets include, but are not limited to, compression fittings, ferrules, seals, gaskets, and the like.

The plug 115 and conductor fitting 117 can be referred to collectively as a plug assembly 120. The plug 115, conductor fitting 117, and bonding electrode 110 can be referred to as an electrode assembly 121. In some embodiments, the plug assembly or the electrode assembly can include the fitting gasket 118 and the plug gasket 116. The electrode assembly 121 typically resides beneath a skimmer basket 167 when the assembly 121 is installed in the pool skimmer 160.

In FIG. 5, the first embodiment water bonding device 100 is shown installed in a swimming pool 180. The swimming pool 180 is a built-in pool. The bonding electrode 110 resides below a pool water surface 185. The pool water 184 extends into the pool inlet filter assembly 160 through a skimmer inlet 162, which extends through a pool wall 182. The bonding electrode 110 typically remains submerged, and thus continues to maintain the pool water at approximately ground potential, so long as the pool water surface 185 remains above a skimmer inlet bottom 163. A pool water conduit 168 typically extends from the second port 174 of the filter inlet component 160 for delivery of water from the first embodiment filter inlet component 160 to a water filtration system 188 and water pump 189.

The ground conductor 125 extends from the bonding electrode 110 through the first port 172 to a ground pole 124. The ground pole 124 can be a grounded object such as, but not limited to, a grounded terminal on a service panel, a metal water pipe that extends into the ground, a metal stake or other metal object installed in the ground and having substantial electrical connectivity therewith, or other electrically conducting object electrically connected to the ground. As illustrated in FIG. 5, water inside the swimming pool is maintained at ground electrical potential.

A Second Embodiment Water Bonding Device

Figure 6:
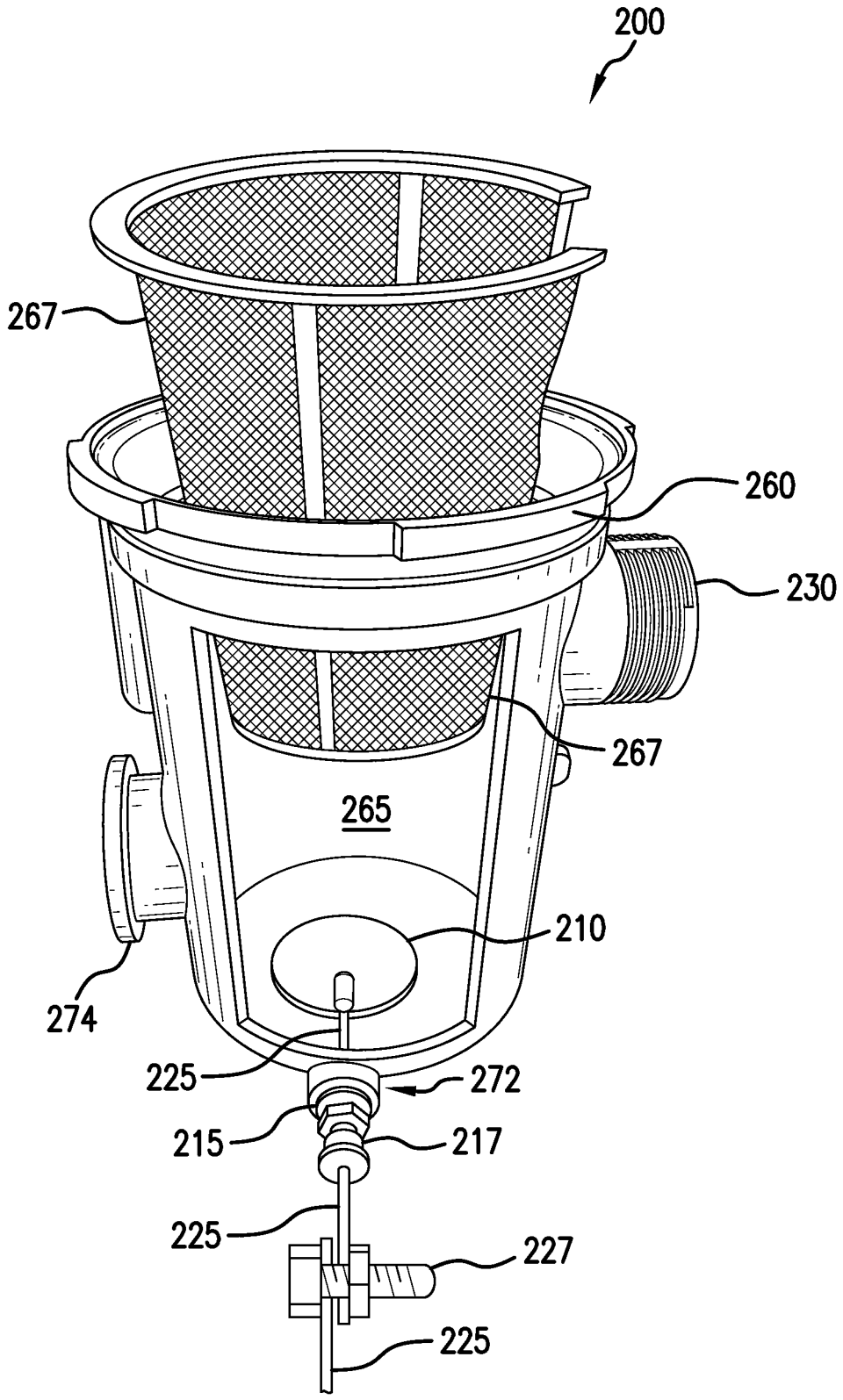
FIG. 6 is a perspective, cut-away view of a water bonding device according to an embodiment of the present invention.
Figure 7:
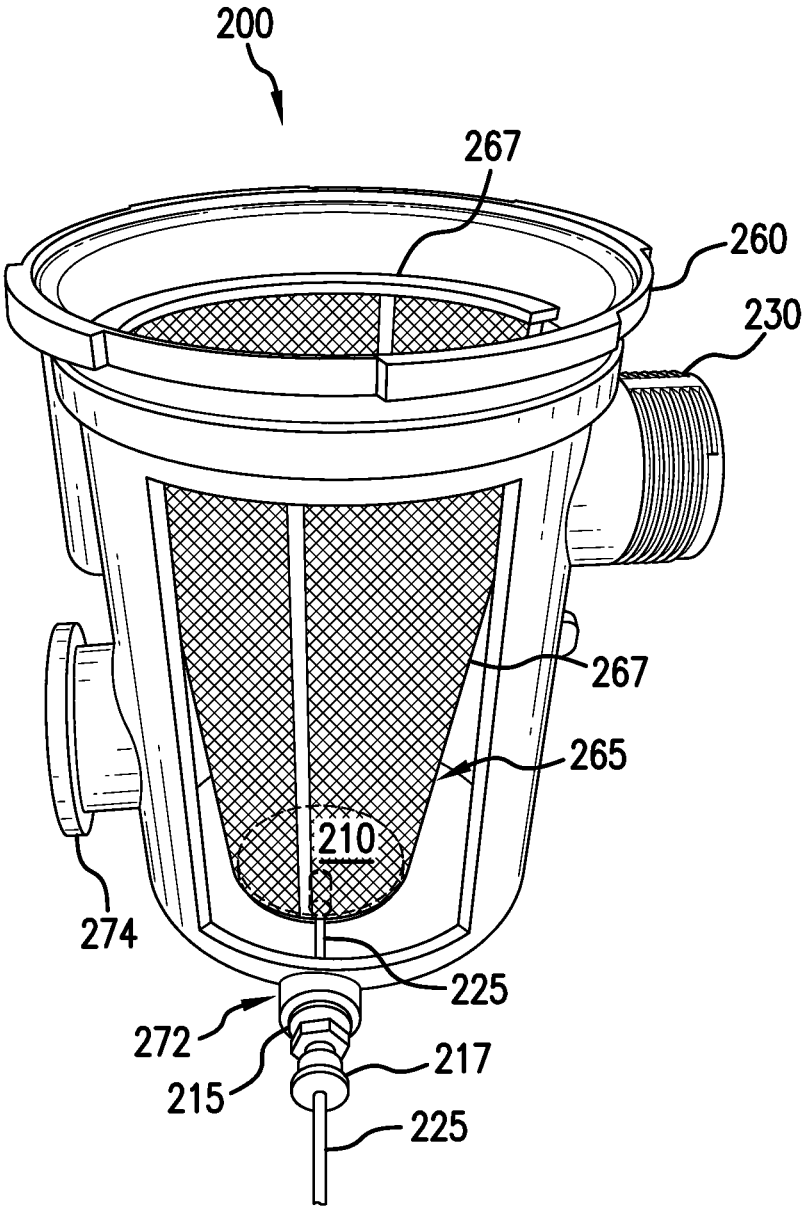
FIG. 7 is a perspective, cut-away view of a water bonding device according to an embodiment of the present invention.
Figure 8:
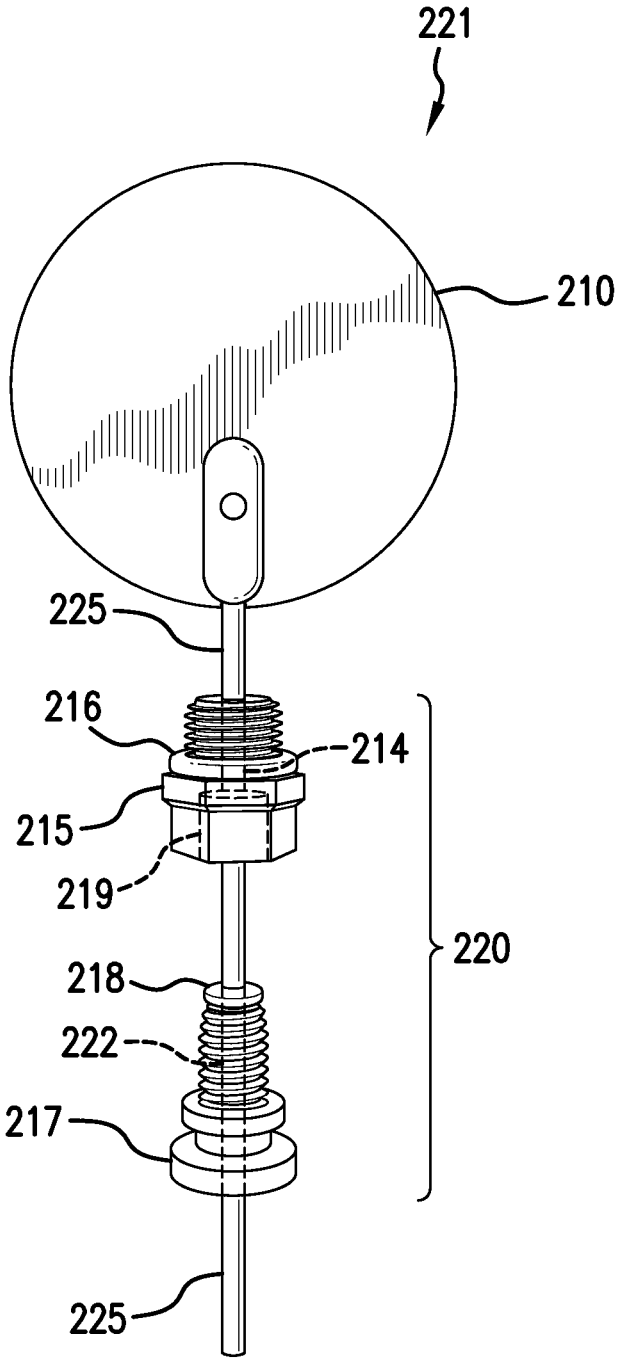
FIG. 8 is a perspective view of an electrode assembly according to an embodiment of the present invention.

A second embodiment water bonding device 200 is illustrated in FIGS. 6-8. The second embodiment water bonding device comprises a filter inlet component 260 including a main cavity 265, and a bonding electrode 210 residing within the main cavity 265. The filter inlet component 260 of the second embodiment is a pump strainer familiar to persons skilled in the art. The pump strainer is typically installed in an above-ground swimming pool. The pump strainer includes a strainer basket 267 for straining water that flows through the main cavity 265. The filter inlet component 260 further comprises an inlet port 230, a drain port 272, and an outlet port. The drain port 272 of the second embodiment is analogous to the first port 172 of the first embodiment water bonding device 100. Accordingly, the drain port of a pump strainer can be referred to as a first port.

The second embodiment water bonding device 200 further comprises a plug 215 threaded into the drain port 272, and thus removably installed therein. The water bonding device 200 further includes a ground conductor 225 directly coupled to the bonding electrode 210. The ground conductor 225 can be referred to as an electrical conductor or a wire.

The water bonding electrode 210 typically comprises a circular disk having a diameter of approximately 2.5 inches, and thus having a surface area of approximately 4.9 square inches for each of the front and back sides of the electrode 210. The ground conductor 225 is typically a #8 AWG solid copper wire. As best seen in FIG. 6, the ground conductor 225 can include separable sections spliced by use of a connector 227. The connector 227 of the second embodiment is typically a split bolt connector.

The second embodiment water bonding device further comprises conductor fitting 217 and a fitting gasket 218, both of which are configured to encircle the ground conductor 225. The conductor fitting 217 is typically a nylon thumb screw that cremovably installs in a fitting receptacle 219, the fitting receptacle 219 being a recess in the plug 215 configured to receive the conductor fitting 217. The conductor fitting 217 typically engages the fitting receptacle 219 via complementary threads residing in the receptacle, resulting in a threaded coupling between the fitting receptacle 219 and the conductor fitting 217. The plug 215 further includes a plug bore 214 (shown in hidden line) that passes through a center of the plug 215.

The conductor fitting 217 includes a fitting bore 222 (shown in hidden line) through a center of the conductor fitting 217, and through which the ground conductor 225 extends. The fitting gasket 218 (see FIG. 8) typically seals against an inside surface of the fitting receptacle. When the conductor fitting 217 is installed in the fitting receptacle 219, the fitting gasket 218 resides within the receptacle 217 and can form a water tight seal around the ground conductor 225. The fitting gasket 218 can furthermore seat against a bottom inside surface of the fitting receptacle 219 to form a water tight seal with the plug 215. The fitting gasket 218 of the second embodiment water bonding device 200 typically comprises an elastomeric O-ring.

The plug 215 and conductor fitting 217 can be referred to collectively as a plug assembly 220. The plug 215, conductor fitting 217, and bonding electrode 210 can be referred to as an electrode assembly 221. In some embodiments, the plug assembly or the electrode assembly can include the fitting gasket 218 and the plug gasket 216. The electrode assembly 221 typically resides outside a strainer basket 267 when the assembly 221 is installed in the pump strainer 260.

The connector 227 that splices the ground conductor 225 of the second embodiment typically resides outside the pump strainer 260 when the electrode assembly 221 is installed in the pump strainer 260. The connector resides a distance from the drain port 272 that is preferably less than 12 inches, more preferably less than 6 inches, and most preferably less than 4 inches. As shown in FIG. 6, the connector 227 resides about 3 inches from the drain port 272.

A Method of Using a Water Bonding Device

A method of using a first embodiment water bonding device 100 includes installing the water bonding device as follows in a built-in swimming pool. The swimming pool typically, but not necessarily, has been previously constructed or installed, and the installation thus includes retrofitting a pre-existing built-in pool. The pre-existing swimming pool includes a pool skimmer 160, which, in combination with the first embodiment water bonding device, provides a convenient port of entry for a ground conductor. The pool skimmer also provides a protected space (the skimmer main cavity 165) within which the bonding electrode 110 can be readily installed. With the bonding electrode installed beneath the skimmer basket 167 at a bottom of the main cavity 165, the electrode is readily accessible, yet is configured to remain under water even where the water drops to a relatively low level.

A first operation of installing the water bonding device includes installing a plug 115 in a first port 172 disposed at a bottom of the pool skimmer 160. The first port 172 is typically one of two ports molded, formed, or otherwise installed in the pool skimmer when the skimmer is manufactured. The plug 115 typically, but not necessarily, includes male threads that engage a complementary set of female threads in the first port 172. The plug forms a water tight seal with the first port, the water tight seal being facilitated by the plug gasket 116. The plug further includes a plug bore 114 that passes through a center of the plug.

A second operation of installing the first embodiment water bonding device includes passing the ground conductor 125 into the skimmer main cavity 165 through the plug bore 114. The second operation is typically, but not necessarily, performed after the first operation, in which case the ground conductor 125 traverses the first port 172 as the conductor passes through the plug bore 114. However, in some methods of use the ground conductor is brought into the main cavity first through the first port, and is subsequently passed through the plug bore 114, in which case the plug 115 is installed in the first port with a portion of the ground conductor already residing in the plug bore 114 and fitting receptacle 119.

A third operation of installing the first embodiment water bonding device includes passing the ground conductor 125 through the fitting gasket 118 and fitting bore 122 of the conductor fitting 117. The first three operations are interchangeable with respect to the order in which they are performed.

A fourth operation of installing the first embodiment water bonding device includes installing the conductor fitting 117 snugly in the fitting receptacle 119, so the conductor fitting 117 forms a water tight seal between the plug 115 and the ground conductor 125. The water tight seal is facilitated by the action of the fitting gasket 118 forming a water tight seal around the ground conductor 125, and also against the fitting receptacle. Accordingly, the first embodiment plug assembly 120, comprising the plug 115, plug gasket 116, conductor fitting 117, and fitting gasket 118, creates a water tight port of entry through which the ground conductor 125 enters the pool skimmer 160 by exploiting the pre-existing first port 172 in the skimmer.

A fifth operation of installing the first embodiment water bonding device includes installing the bonding electrode 110 on the ground conductor 125, thus creating a direct electrical connection between the bonding electrode and the ground conductor.

A sixth operation of installing the first embodiment water bonding device includes installing the skimmer basket 167 in the skimmer. Consequently, the bonding electrode 110 resides in the skimmer main cavity 165 beneath the skimmer basket. The first through sixth operations of installing the first embodiment water bonding device are typically, but not necessarily, performed in the order listed here.

The method of using the first embodiment water bonding device further comprises submerging the bonding electrode 110 in pool water residing in the pool skimmer main cavity 165. The pool water in the main cavity is typically in liquid communication with pool water residing throughout the swimming pool and associated plumbing.

The method of using the first embodiment water bonding device further includes removing the bonding electrode 110 and replacing it with another bonding electrode.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

In an alternative embodiment, the second embodiment plug assembly 220 (see FIG. 8) is used as a water tight seal for bringing an electrical conductor into a tank or vessel through a port of entry in the tank. The port of entry is typically, but not necessarily, a threaded port such as a drain, tank inlet, or tank outlet. The plug 215 and plug gasket 216 together form a watertight seal with the port of entry. The conductor fitting 217 and fitting gasket 218 form watertight seals with the plug 215 and with the electrical conductor 225. In some embodiments, the electrical conductor links a bonding electrode inside the tank or vessel to a ground pole outside the tank. Embodiments include an electrical conductor that links a pH electrode or other sensor inside the tank to an electrical instrument. Variations include an electrical cord for operating a submersible pump within the tank or vessel, or a thermocouple wire for determining temperature in the tank.

I claim:

1. A water bonding device comprising:

a filter inlet component selected from the group consisting of a pool skimmer and a pump strainer, the filter inlet component including a main cavity and a first port disposed proximate a bottom of the main cavity;

a plug assembly removably installed in the first port, the plug assembly including a plug penetrated by a plug bore, the plug forming a water tight seal with the first port; and a bonding electrode (i) comprising a metal structure having a surface area of at least 9.0 square inches, (ii) residing within the main cavity, and (iii) being directly coupled to a ground conductor, the ground conductor extending from within the main cavity through the plug bore to outside the filter inlet component.

2. The device of claim 1, wherein the plug assembly forms a water tight seal around the ground conductor.

3. The device of claim 2, wherein the plug assembly further comprises a conductor fitting removably installed in the plug, the conductor fitting being penetrated by a fitting bore and the ground conductor extending through the fitting bore.

4. The device of claim 3, wherein:

the plug further comprises a fitting receptacle within which the plug fitting is installed; and the plug assembly further comprises a fitting gasket residing within the fitting receptacle and forming a seal around the ground conductor.

5. The device of claim 4, wherein the ground conductor comprises a solid copper wire not smaller than 8 AWG.

6. The device of claim 5, wherein the filter inlet component is a pool skimmer and the bonding electrode is removably coupled to the ground conductor.

7. A water bonding system comprising:

a built-in swimming pool comprising a pool wall;

the water bonding device of claim 6, wherein the pool skimmer further includes:

a skimmer inlet projecting through the pool wall;

a second port directly coupled to a pool water conduit, the pool water conduit providing fluid communication between the pool skimmer and a pool filter.

8. The water bonding device of claim 5, wherein the pool filter inlet component is a pump strainer and the first port is a drain port.

9. The water bonding device of claim 8, wherein the ground conductor is spliced with a connector, the connector residing outside the main cavity and within 12 inches of the drain port.

10. A water bonding device comprising:

a plug assembly including (i) a plug penetrated by a plug bore, and (ii) a fitting receptacle residing in the plug;

a conductor fitting configured to removably install in the fitting receptacle, the conductor fitting being penetrated by a fitting bore;

a bonding electrode comprising a metal structure having a surface area of at least 9.0 square inches, the bonding electrode being adapted to affix to a #8 AWG or larger solid copper conductor.

11. A method of using the water bonding device of claim 10 comprising:

providing a built-in swimming pool, the swimming pool including a pool skimmer having a main cavity and a first port;

passing a first end of a ground conductor from outside the pool skimmer through the first port, the plug bore, and the fitting bore;

installing the plug in the first port;

installing the fitting in the fitting receptacle;

installing the bonding electrode on the ground conductor proximate the first end, whereupon the bonding electrode resides within the main cavity.

12. The method of claim 11, wherein the plug assembly forms a water tight seal with the ground electrode and with pool skimmer.

13. The method of claim 12, wherein the ground conductor is directly coupled to a ground pole.

14. The method of claim 13, wherein the pool skimmer further comprises a second port directly coupled to a pool water conduit, the pool water conduit providing fluid communication between the pool skimmer and a pool filter.

15. The method of claim 14, further comprising at least partially filling the swimming pool with water, the water extending from the swimming pool into the cavity and submerging the bonding electrode.

16. The method of claim 15, wherein the swimming pool water and ground pole have approximately equal electric potential.

17. A water bonding device comprising:

a pool skimmer including:

an inlet;

a main cavity;

a first port disposed at a bottom of the main cavity;

a second port disposed at the bottom of the main cavity; and a skimmer basket residing in the main cavity;

a plug assembly removably installed in the first port, the plug assembly including a plug penetrated by a plug bore, the plug forming a water tight seal with the first port; and a bonding electrode (i) comprising a metal structure having a surface area of at least 9.0 square inches, (ii) residing within the main cavity beneath the skimmer basket, and (iii) being directly coupled to a ground conductor, the ground conductor extending from within the main cavity through the plug bore to outside the filter inlet component.

18. The water bonding device of claim 17, wherein the ground conductor is directly coupled to a ground pole.

19. The water bonding device of claim 18, wherein the second port is directly coupled to a pool water conduit, the pool water conduit providing fluid communication between the pool skimmer and a pool filter.

20. The water bonding device of claim 19, wherein the pool water conduit is directly coupled to the pool filter.

* * * * *